US009631432B2

(12) United States Patent
Downton

(10) Patent No.: US 9,631,432 B2
(45) Date of Patent: Apr. 25, 2017

(54) MUD ACTUATED DRILLING SYSTEM

(71) Applicant: Schlumberger Technology Corporation, Sugar Land, TX (US)

(72) Inventor: Geoffrey C. Downton, Stroud (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 578 days.

(21) Appl. No.: 14/057,866

(22) Filed: Oct. 18, 2013

(65) Prior Publication Data

US 2015/0107902 A1 Apr. 23, 2015

(51) Int. Cl.

| | |
|---|---|
| ***E21B 7/06*** | (2006.01) |
| ***E21B 34/06*** | (2006.01) |
| ***E21B 7/04*** | (2006.01) |
| ***E21B 47/024*** | (2006.01) |
| ***E21B 23/04*** | (2006.01) |
| ***E21B 41/00*** | (2006.01) |

(52) U.S. Cl.

CPC ..... *E21B 7/062* (2013.01); *E21B 7/04* (2013.01); *E21B 23/04* (2013.01); *E21B 34/066* (2013.01); *E21B 41/0085* (2013.01); *E21B 47/024* (2013.01)

(58) Field of Classification Search

CPC ..... E21B 7/062; E21B 23/04; E21B 41/0085; E21B 47/024; E21B 34/066; E21B 7/04

USPC ..... 175/61, 62

See application file for complete search history.

(56) References Cited

U.S. PATENT DOCUMENTS

| | | | | |
|---|---|---|---|---|
| 4,947,944 | A * | 8/1990 | Coltman | E21B 17/1014 175/325.3 |
| 5,971,085 | A * | 10/1999 | Colebrook | E21B 7/06 175/266 |
| 7,225,888 | B1 * | 6/2007 | Van Steenwyk | E21B 7/062 175/61 |
| 8,011,452 | B2 * | 9/2011 | Downton | E21B 7/062 175/61 |
| 9,016,400 | B2 * | 4/2015 | Clausen | E21B 7/06 175/61 |
| 2002/0179336 | A1 * | 12/2002 | Schaaf | E21B 7/06 175/61 |
| 2010/0139980 | A1 * | 6/2010 | Neves | E21B 7/064 175/61 |
| 2012/0160565 | A1 * | 6/2012 | Downton | E21B 7/062 175/61 |

* cited by examiner

*Primary Examiner* — Michael Wills, III

(57) ABSTRACT

A technique facilitates drilling of a variety of a wellbores. The technique comprises providing a directional drilling system with a drill bit mounted at the end of a collar having an internal flow passage for drilling fluid. The collar is rotatably positioned in a steering structure to which a plurality of steering members is mounted for lateral motion with respect to the steering structure. The design allows the steering structure to remain rotationally stationary with respect to the surrounding borehole wall as the collar and drill bit are rotated to perform a drilling operation. The drilling orientation of the collar and the drill bit may be adjusted by routing drilling fluid from the internal flow passage to at least one of the steering members to cause lateral displacement of the steering member while the steering structure remains in the rotationally stationary position.

18 Claims, 4 Drawing Sheets

MUD ACTUATED DRILLING SYSTEM

BACKGROUND

Hydrocarbon fluids such as oil and natural gas are obtained from a subterranean geologic formation, referred to as a reservoir. Often, wellbores are drilled into the reservoir to enable recovery of the hydrocarbon fluids. The wellbores are drilled with drill strings which may be constructed from a variety of components to facilitate the drilling operation. For example, many different types of equipment and techniques may be employed to rotate a drill bit with suitable cutters configured for cutting away the formation rock. In some applications, steering systems, e.g. rotary steerable systems, also are used to control the direction of drilling to ensure the wellbore follows a desired route into the reservoir.

SUMMARY

In general, a system and methodology are provided for drilling a wellbore. The technique comprises providing a directional drilling system with a drill bit mounted at the end of a collar having an internal flow passage for drilling fluid, e.g. drilling mud. The collar is rotatably positioned in a steering structure to which steering members are mounted for lateral motion with respect to the steering structure. The design allows the steering structure to remain rotationally stationary with respect to the surrounding borehole wall as the collar and drill bit are rotated to perform a drilling operation. The drilling orientation, e.g. the verticality, of the collar and the drill bit may be adjusted by routing drilling fluid from the internal flow passage to at least one of the steering members to cause lateral displacement of the steering member while the steering structure remains in the rotationally stationary position.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology related to the drilling of boreholes. The technique enables construction and use of a directional drilling system which may be guided via a low-cost sensing package and low cost telemetry system. In some applications, the directional drilling system may be constructed as a vertical drilling system in which steering members are controlled to maintain verticality of drilling.

According to an embodiment, a directional drilling system is coupled into a drill string and constructed with a drill bit mounted at the end of a collar. The collar has an internal passageway along which drilling mud or other drilling fluid may be directed to the drill bit. The drilling fluid also may be used to power a plurality of steering members positioned to steer the directional drilling system. For example, the collar may be rotatably positioned in a steering structure, e.g. a steering sleeve, to which the plurality of steering members is mounted. The steering members are positioned to provide lateral motion with respect to the steering structure.

Additionally, the design of the directional drilling system allows the steering structure to remain rotationally stationary with respect to the surrounding borehole wall as the collar and drill bit are rotated to perform a drilling operation. The drilling orientation of the collar and the drill bit may be adjusted by routing drilling fluid from the internal flow passage to at least one of the steering members to cause lateral displacement of the steering member while the steering structure remains in the rotationally stationary position.

Figure 1:
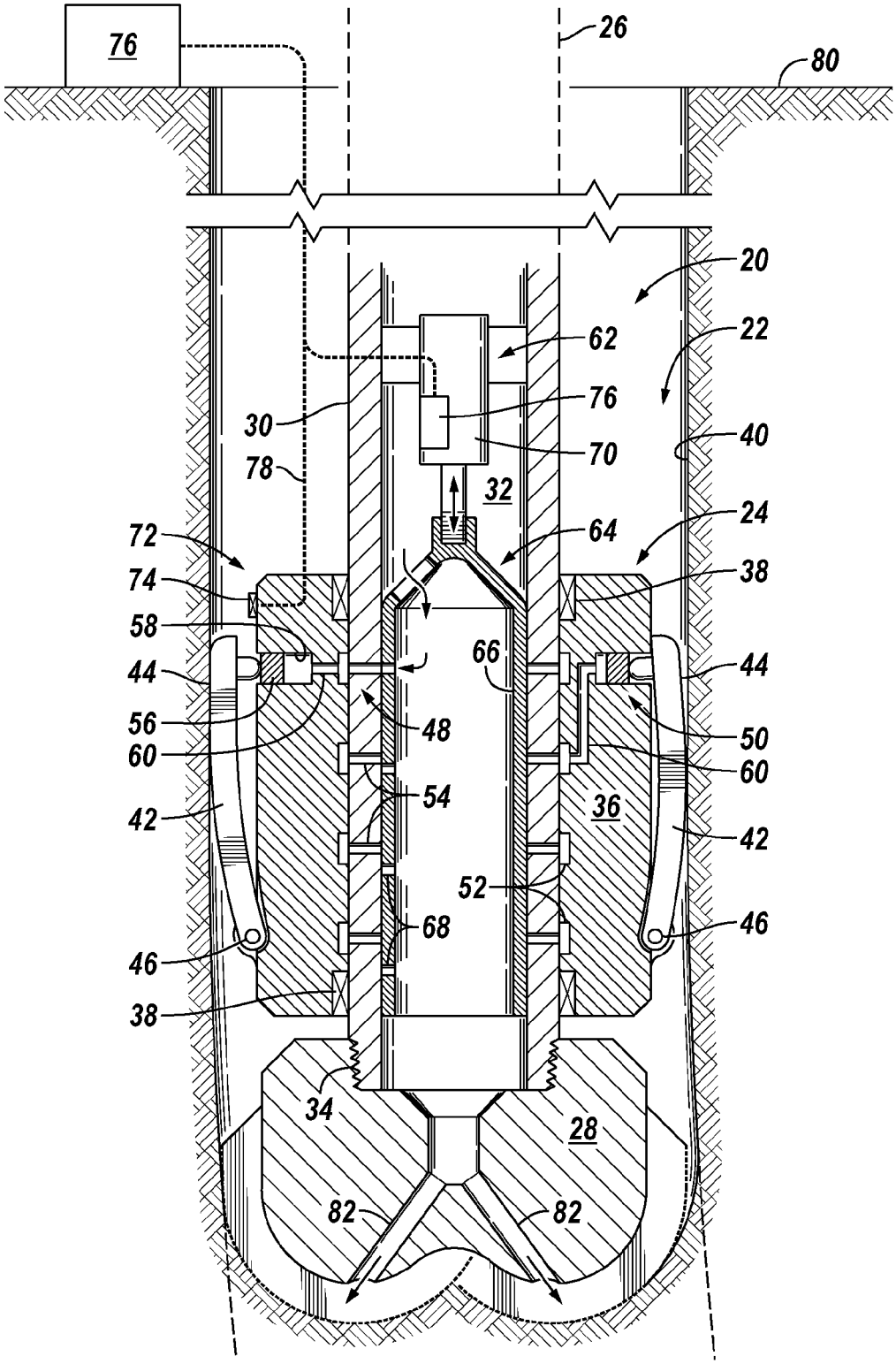
FIG. 1 is an illustration of an example of a steering system coupled to a drill bit for drilling a borehole, according to an embodiment of the disclosure.

Referring generally to FIG. 1, an example of a directional drilling system 20 is illustrated as deployed in a borehole 22, e.g. a wellbore. The directional drilling system comprises a steering system 24 mounted to a drill string 26. Additionally, the steering system 24 is coupled with a drill bit 28 which may be rotated to drill the borehole 22. Rotational motion may be imparted to the drill bit 28 by a variety of systems, including downhole systems, e.g. mud motors or turbines, and surface systems which impart rotation by rotating the drill pipe. The directional drilling system 20 also may be used in coiled tubing applications which utilize a mud motor or other downhole source to provide the rotational motion.

In the example illustrated, steering system 24 comprises a collar 30 having an internal flow passage 32 and a mounting end 34 to which drill bit 28 is mounted. The steering system 24 also comprises a steering structure 36 which is mounted about the collar 30. Collar 30 is rotatable within the steering structure 36 via a bearing or a plurality of bearings 38, e.g. mud lubricated bearings or sealed oil bearings. In the example illustrated, steering structure 36 is in the form of a steering sleeve mounted circumferentially about collar 30, and collar 30 is freely rotatable within the surrounding steering sleeve. The steering structure/sleeve 36 may remain stationary with respect to a surrounding borehole wall 40 (which defines borehole 22) as collar 30 and drill bit 28 are rotated to perform a drilling operation.

Referring again to FIG. 1, a plurality of steering members 42, e.g. steering ribs or blades, may be mounted to exert a lateral force against steering structure 36 in a manner which adjusts the drilling direction of drill bit 28. By way of example, the steering members 42 may be mounted to steering structure 36 for lateral, e.g. radial, movement against the surrounding borehole wall 40. The steering members 42 may be constructed in a variety of forms, including telescopic forms and pivoting forms. In the illustrated example, each steering member 42 comprises a contact pad 44 and is pivotably mounted to steering structure 36 via a pivot 46, e.g. a hinge. As the steering member 42 is pivoted about pivot 46 and moved in the laterally outward direction, the contact pad 44 is pressed against the borehole wall 40 to move steering structure 36 and drill bit 28 in an opposite direction. In the embodiment illustrated, steering members 42 are selectively and individually controllable to enable maintenance of verticality or other directional control over drilling. The steering structure 36 may remain stationary with respect to borehole wall 40, and therefore the steering members 42 can be constructed at a lower cost with lower cost materials because they do not have to slip against the surrounding rock of borehole wall 40.

The steering system 24 also comprises a hydraulic network 48 between the internal flow passage 32 and the steering members 42. The hydraulic network 48 may be configured to provide flow paths between internal flow passage 32 and steering actuators 50 associated with corresponding steering members 42. In the illustrated embodiment, the hydraulic network 48 also comprises a plurality of annular grooves 52 disposed along an interior of the steering sleeve 36. The annular grooves 52 are aligned with transverse passages 54, e.g. radial passages, extending through collar 30. The annular grooves 52 also are fluidly coupled with steering actuators 50. For example, each annular groove 52 may be associated with a specific, corresponding steering actuator 50. It should be noted that bearings 38 may be positioned at ends of steering sleeve 36 and/or intermediate the annular grooves 52.

In the illustrated embodiment, steering actuators 50 are in the form of hydraulic pistons 56 slidably mounted in corresponding cylinders 58; and each cylinder 58 is in fluid communication with a specific, corresponding annular groove 52 via a port 60. Hydraulic pistons 56 may be mud actuated pistons which are actuated via the pressure differential between internal flow passage 32 and the surrounding annulus between steering structure 36 and borehole wall 40.

The steering system 24 further comprises an actuator system 62 having an actuator 64 able to control flow through the hydraulic network 48 so as to actuate selected steering members 42. Directional control may be provided by actuating selected steering members 42 during rotation of collar 30 while the steering structure 36 remains rotationally stationary with respect to borehole wall 40. The actuator system 62 and actuator 64 may be constructed according to a variety of embodiments. In the illustrated example, the actuator 64 comprises a valve sleeve 66 having a plurality of passages 68 which control flow of drilling fluid, e.g. drilling mud, from internal flow passage 32 to the steering members 42 via steering actuators 50.

The actuator system 62 also may comprise a motive unit 70 coupled to the valve sleeve 66 for moving the valve sleeve back-and-forth to selectively align passages 68 with corresponding annular grooves 52 so as to actuate specific steering members 42. By way of example, motive unit 70 may comprise an electric motor able to provide linear motion to the valve sleeve 66. In some applications, the motive unit 70 is in the form of a digital actuator. In other embodiments, however, the motive unit 70 may be a rotary unit, e.g. an electric motor, configured to provide rotational movement to sleeve 66. In this latter example, the valve sleeve passages 68 and the grooves 52 are arranged to enable selective flow of fluid to desired steering actuators 50 as a result of rotational motion.

Figure 3:
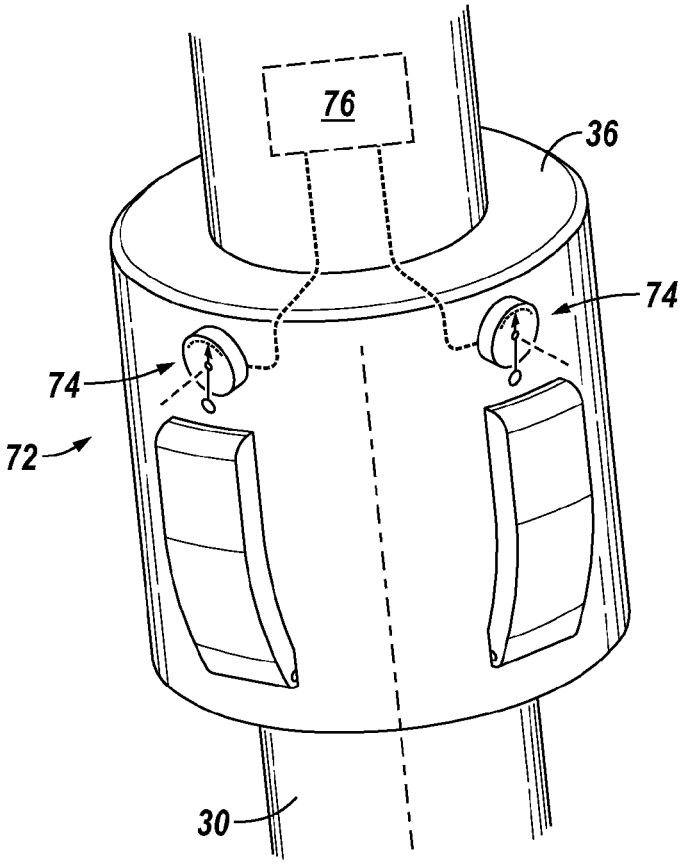
FIG. 3 is an illustration of an example of a directional sensing and control system that may be used with the steering system, according to an embodiment of the disclosure.

A sensor system 72 having a sensor or sensors 74 may be part of the steering system 24, and sensors 74 may be located to detect drilling system orientation and drilling direction. (See also FIG. 3). For example, the sensor or sensors 74 may be configured and located to sense verticality of the collar 30 and thus of the drilling direction during drilling. Data from sensor system 72 is output to one or more controllers 76 via a telemetry system 78. The controller(s) 76 may comprise a digital controller, such as a microprocessor-based controller. In some applications, the controller 76 may be positioned at a surface location 80 and in other applications the controller 76 may be positioned downhole. Additionally, some applications may utilize controllers 76 at both the surface and downhole to enable control from either location. Depending on the application, the downhole controller 76 also may be used to provide a closed loop control which automatically maintains a predetermined drilling direction.

It should be noted that a variety of drill bits may be used depending on the parameters of the drilling operation and the characteristics of the environment. The mounting end 34 is configured to accommodate attachment of a variety of drill bits. In many applications, the drill bit 28 comprises mud flow passages 82 through which drilling mud is directed from internal flow passage 32 to help remove cuttings that result from the drilling operation.

The number of steering members 42 may vary depending on the parameters of a given application. In the example illustrated, four steering members are used to provide directional control, but other numbers of steering members 42 can be incorporated into the design. Generally, the number of annular grooves 52 corresponds with the number of steering members 42. If, for example, four steering members 42 are mounted on steering structure 36, then four annular grooves 52 would be formed in steering structure 36. Each groove 52 may be pressure isolated from adjacent grooves by using close running tolerances between the steering sleeve 36 and the collar 30, by labyrinth seals, by dynamic elastomeric seals, or by other suitable techniques. Each annular groove 52 is fluidly coupled with one corresponding actuator 50 via the port 60 associated with that specific actuator 50. Additionally, each annular groove 52 is aligned with corresponding transverse passages 54 extending through collar 30 so that pressurized fluid, e.g. drilling mud, can be communicated from internal flow passage 32 to the desired piston 56 when valve sleeve 66 is appropriately shifted.

A number of techniques may be employed to ensure that pistons 56 do not become hydraulically locked in an extended position once they have been disconnected from the high-pressure source supplying drilling fluid along internal flow passage 32. For example, the pistons 56 may be protected against hydraulic locking through natural leakage from the pistons 56 or across seals associated with the pistons 56. Additionally, small "weep" paths may be located to release locked in pressure to the surrounding annulus. By way of example, the weep paths may be formed through the pistons 56. Additionally, the weep paths may be configured to provide greater leakage than the potential leakage to adjacent, low-pressure annular grooves, thus preventing adjacent pistons (non-activated pistons) from becoming "charged" by cross annular leakage if such cross annular leakage exists. Some applications may utilize a certain amount of cross annular leakage to provide lubrication for seals positioned between annular grooves 52.

To achieve a desired steering response, the sliding or rotating valve sleeve 66 is configured with properly positioned ports or passages 68. For example, the valve sleeve 66 may be moved by motive actuator unit 70 to axially align a specific passage 68 with a specific corresponding passage 54 of collar 30. Alignment of selected passages 68 and 54 effectively exposes the corresponding steering member 42, via piston 56, to the pressure differential between the internal flow passage 32 and the surrounding annulus. If the valve sleeve 66 is axially actuated, then the spacing between passages 68 is different than the spacing between the transverse passages 54 of collar 30 so as to seal off the passages 68 which do not correspond with the selected steering member 42.

If the valve sleeve 66 is a rotatable sleeve, a similar system of staggered passages/ports can be used to enable alignment of passages and thus selective flow to a specific steering member 42 while flow to the other steering members 42 is blocked. In some applications, both axial and rotatable motion of valve sleeve 66 can be used to provide additional modes of operation. Movement of valve sleeve 66 may cause momentary energization of pistons 56 as the valve sleeve 66 is moved to its desired position for activation of its selected piston 56 and corresponding steering member 42. However, such momentary energizations are so short in duration as to have virtually no steering consequence.

In some embodiments, the structure of valve 66 and the overall hydraulic network 48 may be configured with an actuation position which provides simultaneous flow to the plurality of pistons 56. This mode of operation would tend to force the plurality of steering members 42 laterally outward at the same time. Similarly, valve 66 and hydraulic network 48 may be configured to completely cut off flow of fluid to the plurality of pistons 56, thus leaving the steering members 42 at a de-actuated, radially inward position. Such modes can be used when it is desired to make sure steering sleeve 36 is held in a non-rotating position, e.g. when taking a verticality measurement, or when running in hole past radially reduced sections, e.g. casing exits, through completions, and other reduced sections.

Figure 2:
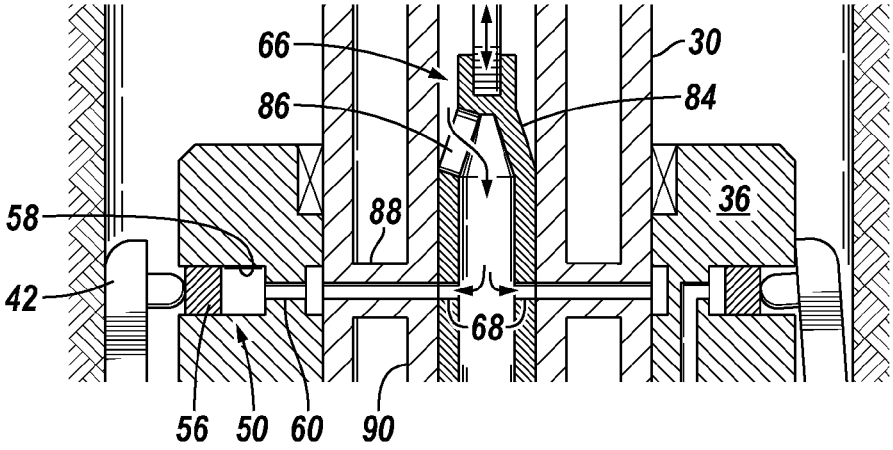
FIG. 2 is an illustration of a portion of another example of a steering system, according to an embodiment of the disclosure.

With additional reference to FIG. 2, the valve sleeve 66 may be formed with a narrow diameter in some embodiments. By way of example, the valve sleeve 66 may be constructed as a hollow shaft 84 having a mud inlet port 86. Pressurized mud flows into the interior of hollow shaft 84 via inlet port 86 and is delivered outwardly through transverse, e.g. radial, channels 88. In this example, the transverse channels 88 extend between collar 30 and an internal pipe structure 90 which slidably (and/or rotatably) receives valve sleeve 66 in the form of hollow shaft 84. The smaller sliding sleeve can be used to enhance operation by reducing the mass and friction of the sliding sleeve.

A variety of components may be employed in cooperation with the various systems used in constructing directional drilling system 20. For example, a variety of filters may be positioned to filter the actuating fluid, e.g. drilling mud. Filters may be placed over the valve sleeve passages 68, at an entrance to ports 60 of steering structure 36, or at other suitable locations. Filtering also may be performed above and/or below the sliding sleeve depending on the flow direction of the drilling mud as it enters the region.

Steering control may be provided according to a variety of techniques depending on component structure, type of control system, type of telemetry system, and the overall configuration of the directional drilling system 20. In the embodiment illustrated, the valve sleeve 66 rotates with the drill bit 28. However, the annular grooves 52 in the steering structure/sleeve 36 ensure that a specific, selected steering member 42 is actuated regardless of the rotational angle of drill bit 28. Provided the steering members 42 do not rotate with respect to the borehole wall 40, the valve actuator, e.g. motive unit 70, does not have to continually change the valve sleeve position to achieve a desired correction with respect to the steering direction. In the event the steering structure/sleeve 36 starts to rotate, then motive unit 70 can be adjusted to change the position of valve sleeve 66 to accommodate for the rotational movement of steering sleeve 36.

To maintain drilling in a desired direction, e.g. a vertical direction, sensor system 72, controller 76, and telemetry system 78 may be used in cooperation according to a suitable control scheme. In an example, sensor 74 comprises a verticality measuring sensor mounted on the non-rotating steering sleeve 36, as illustrated schematically in FIG. 3. In this example, a plurality of sensors 74 is positioned on sleeve 36, and the sensors 74 may comprise orthogonal single axis accelerometers, orthogonal single axis tilt sensors, orthogonal single axis liquid switches, orthogonal single axis pendulums damped in oil, orthogonal single axis compound pendulums damped in oil, or other suitable verticality sensors. The sensors 74 may be fixed on the non-rotating steering structure 36, e.g. steering sleeve, to provide a measurement of the verticality of the steering structure 36 (and thus the borehole 22) in the reference frame of the steering structure itself. Steering members 42 also are fixed in the same reference frame so it is straightforward to directly associate tilt direction with the appropriate steering member 42 to be actuated for correcting the drilling direction and thus borehole orientation back to vertical. As the position of the sliding valve sleeve 66 is uniquely associated with actuating a specific, selected steering member 42, the movement of valve sleeve 66 via motive unit 70 (e.g. linear stroke or rotation) is readily determined for achieving the desired actuation of the appropriate steering member 42.

Figure 5:
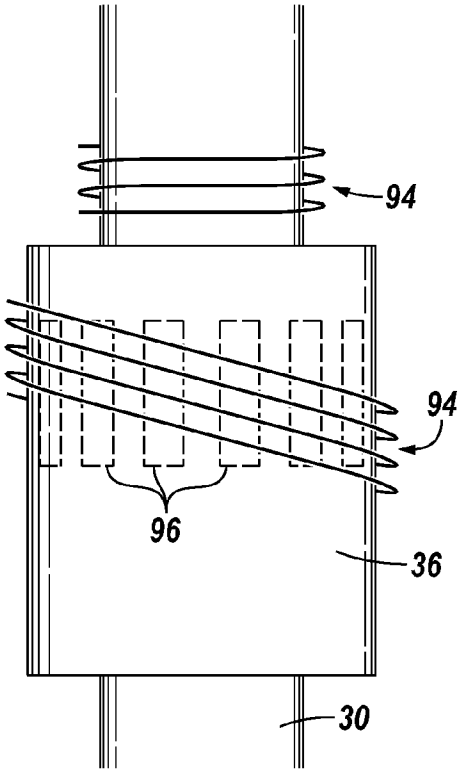
FIG. 5 is an illustration of another example of a directional sensing and control system that may be used with the steering system, according to an embodiment of the disclosure.
Figure 4:
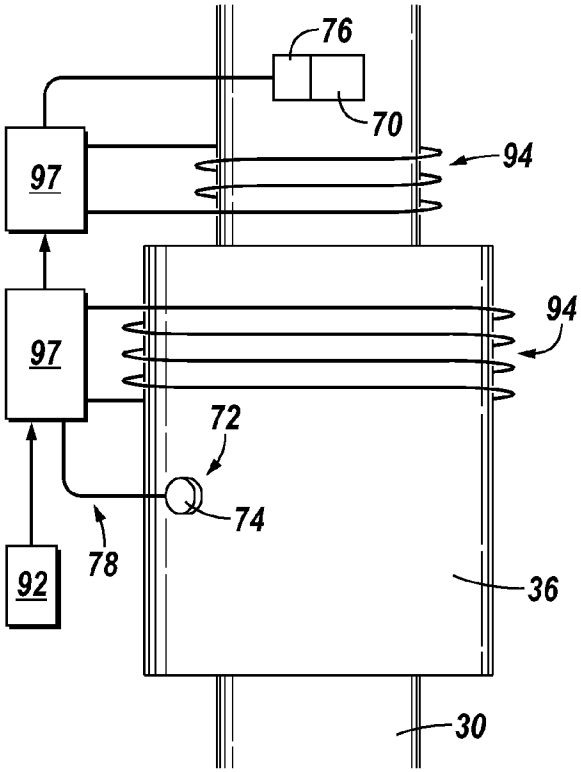
FIG. 4 is an illustration of another example of a directional sensing and control system that may be used with the steering system, according to an embodiment of the disclosure.

Telemetry system 78 and controller 76 may be used to provide appropriate control information to sliding valve motive unit 70. In the example illustrated in FIG. 4, an embodiment is provided for energizing sensors 74 on non-rotating sleeve 36 and for getting sensor data to sliding sleeve motive unit 70. In this example, power may be supplied to sensors 74 and motive unit 70 via a battery 92 and/or by the relative motion between non-rotating steering structure 36 and collar 30. Coils 94 on steering structure 36 and collar 30 may be used for the inductive transmission of power supplied to sensors 74 and sliding sleeve motive unit 70 via appropriate circuitry 97. In the case where the relative motion is used to generate electrical power, magnets and generator coils may be positioned to generate the power. For example, magnets may be positioned on the collar 30 and functionally coupled with generator coils on the steering structure 36. However, by orienting the coils 94 in a tilted orientation and using magnets 96 on collar 30 both power generation and inductive power transmission can be provided to enable a combination of power generation, transmission, and communication. An example of such a system is illustrated in FIG. 5. Thus, coils 94 may be used between the collar 30 and the steering structure 36 to transmit signals, e.g. both power and information signals. The tilted coils 94 may be used on the steering structure 36 for power generation, transmission, and/or communication signals.

Sensor data can be transmitted to controller 76 via a suitable telemetry system 78. In a closed loop system, for example, sensor data may be transferred to controller 76 mounted downhole on, for example, sliding sleeve motive unit 70. In some applications, the sensor information can be transmitted to the downhole controller 76 via magnetic induction. The transfer of signals via magnetic induction may be accomplished by using separate coils. Or, in the case where the power generating coils 94 already exist, a secondary signal can be imposed from the steering sleeve side to convey tilt information and steering member information to the processor 76 associated with sliding valve motive unit 70. If four steering members 42 are employed, a minimum of 2 bits (1 out of 4) of information may be used for actuation of specific individual steering members 42. Because this level of information transfer is relatively low, other communications media also may be used, such as an acoustic tone (1 of 4 levels or four frequencies) or pressures wave (e.g. a pressure wave created by a fluttering poppet valve). The communications media provide signals which are sensed by appropriate sensors of controller 76 on valve sleeve motive unit 70.

In another embodiment, sensor system 72 employs a strap down sensor technology which is fixed in and rotating with the collar 30. In this example, sensors 74 may comprise a Hall probe sensor mounted on collar 30 and used to determine the relative position of the steering structure 36 with respect to the collar 30 in real-time. (A magnet in the non-rotating steering structure 36 may be sensed by the Hall probe sensor 74 as the collar 30 rotates to trigger a counter that resets at each rotation. The counts provide a rough indication of angle if the non-rotating steering structure 36 does not slip a detrimental amount and provided the angular velocities of the drill bit 28 and sleeve do not change too much over one drill bit revolution.

In this example, the angular position of each steering member 42 is known in real time with respect to the collar 30. In a basic implementation, the strap down sensor system 72 comprises a minimum of two sensors 74 in the form of a single accelerometer and a single magnetometer measuring, respectively, the gravity and magnetic field vectors perpendicular to the collar 30. (In another example, sensors 74 may comprise a gyro used to follow the angular motion via integration of the rate with offset correction on each revolution or over multiple revolutions as supplied by the Hall probe sensor.) On each rotation of the collar 30, the magnetometer senses a sinusoidal component of the Earth's magnetic field. If the steering structure 36 does not slip, the Hall probe trigger should occur at the same phase point on the sinusoidal waveform. The sine wave is further used with the Hall probe counts to better estimate angular motion of the drill bit 28 with respect to the steering structure 36. As the collar 30 rotates, the accelerometer senses the ambient acceleration (noise and centripetal effects) and a sinusoidal component of gravity.

The accelerometer data may be averaged in bins of incremental angle rotated by the drill bit 28 using the magnetometer/count data and the fact that the drill string tends to rotate in one direction while the Hall probe sensor provides a phase datum for this binned data. The data may be averaged in these bins to produce a bin-sine wave of the collar tilt (e.g. over several minutes of drilling or several hundred rotations). The phase of the bin-sine wave with respect to the Hall probe datum identifies which steering member 42 is to be activated. The amount of averaging depends on the lateral acceleration noise and the effectiveness of the curve fit of the most appropriate sine wave to the data. The steering control action is to drive the amplitude of the sinusoidal component of the bin-sine wave to zero, a condition that arises when the collar 30 is vertical. This approach utilizes knowledge of where the steering members 42 are with respect to the maximum tilt so that sufficient knowledge exists to energize the appropriate steering member or members 42 to correct for that tilt. An appropriate controller 76 is used to process this data and to correct for the tilt. The data provided by sensors 74 to controller 76 enable selection of the appropriate steering member 42 and steering member quadrant to achieve the desired tilt correction. Sensor system 72 also may be modified with additional sensors 74, e.g. additional accelerometers and magnetometers, for reducing the filtering time in washing out the effects of noise and bias and for improving the accuracy of the angular measurement.

In another embodiment, directional control is provided by surface control, e.g. locating controller 76 at a surface location 80. The surface control may still comprise a closed loop control utilizing controller 76 at the surface rather than downhole with the tool. In this example, the steering structure 36, e.g. steering sleeve, is separate and not communicating with the sensor system used for measuring inclination and azimuth, e.g. there is no communication with a measurement-while-drilling system of the drill string. Effectively, the steering structure 36 is a dumb system and the steering members 42 are controlled from the surface. The system may thus be constructed without communication between an inclination measurement system and a steering system. For example, actuation signals for the appropriate steering member 42 may be telemetered down to the steering system 24 using an appropriate telemetry technique, e.g. flow variations, drill string rotation, or other suitable telemetry technique. Downhole sensor system 72 may still be used to measure orientation, e.g. verticality, of the steering system 24 via sensors 74.

At the surface, an operator obtains information from sensor system 72 as to the extent of the offset in verticality and its direction in azimuth. However, the operator may not have knowledge with respect to the datum on the steering sleeve and thus may not have knowledge as to which steering member 42 is to be activated. Consequently, the orientation of the steering members 42 relative to the direction of tilt is determined, and one way to make this determination is to hold the drill bit 28 stationary and to start a flow of drilling fluid. Then, each steering member 42 is energized in sequence and the measurement-while-drilling system of drill string 26 is used to measure the change in orientation of the collar as each steering member 42 is extended laterally. This data can then be used to determine how the steering members 42 are aligned with respect to North. Once the orientation of the steering members 42 and steering structure 36 is known in conjunction with knowledge of the direction of tilt, the operator can provide instructions via surface controller 76 to the steering system 24 to ensure actuation of the desired steering member 42.

The accuracy of the steering inputs telemetered downhole can be assessed at a subsequent survey point, and subsequent steering commands may be adjusted to account for slippage of steering structure 36 during drilling. Steering may be aided further by arranging for a port on the steering sleeve 36 to align with a port in the collar 30 to cause a pressure pulse to be generated on each rotation of the drill bit 28. During drilling, the angular phase relationship between the pulse and any datum on the drill string rotary table should remain fixed for fixed drilling parameters. Shifting of the angular phase relationship is evidence of the steering sleeve 36 slipping relative to the borehole wall 40 and provides a reason for selecting a different steering member 42 for actuation. As the drilling proceeds, the drill string measurement-while-drilling system also may be used to give periodic updates on progress towards verticality and to provide further information to facilitate appropriate selection of steering members 42 for actuation. After a period of trial and error, the relationship between steering member direction, pressure pulse phase, and direction of tilt can be better understood so that steering changes may be selected more accurately and more swiftly.

With respect to communicating command signals down to motive unit 70, a variety of telemetry systems 78 may be used. For example, pressure pulse telemetry systems may be employed in which pressure changes are induced by mud flow variations, e.g. interruptions, created at the surface. However, other telemetry systems may utilize measurement of turbine speeds on alternator/generator sets, electromagnetic signatures delivered downhole, acoustic signals sent downhole, and/or other appropriate telemetry techniques for delivering command signals downhole.

In some applications, telemetry system 78 may be used without the measurement-while-drilling system normally included in drill string 26, thus allowing for removal of the measurement-while-drilling system from the drill string 26 and substantial reduction of costs. In some applications, one of the passages 68 on valve sleeve 66 may be a vestigial passage, as far steering is concerned, which is opened at the extreme upward or downward movement of the valve sleeve 66. At a suitable point in the drilling cycle, e.g. just after the mud pumps are activated, the actuator system 62 may alternate flow through this vestigial passage to generate a pulse or wave train of pressure variations to the surface. The pulse or wave train can be used to encode verticality information, e.g. degrees of tilt, which is sent to the surface to indicate how well the drilling process is proceeding.

With the embodiment illustrated in FIG. 1, for example, the valve sleeve 66 may be moved by motive unit 72 to a new position (not encountered during drilling) where the vestigial passage 68 in the valve sleeve 66 aligns with a corresponding transverse passage 54 through collar 30. These "extra" passages 68 and 54 can serve as telemetry passages that may be aligned to create a telemetry alignment position and resultant pulse. When drilling fluid is flowing, a pressure source is created between the inside of the collar 30 and the surrounding annulus due to the mud flow passages 82 in drill bit 28 creating back pressure. The steady-state pressure may be measured by control system sensors at the surface.

When the telemetry alignment passages 68, 54 align, however, a pressure drop occurs because the drilling fluid is leaking through an orifice in addition to flowing through passages 82 in drill bit 28. The pressure drop may be measured at the surface. By moving these telemetry ports in and out of alignment, a pressure wave train can be effectively sent to the surface. Various encoding methods, e.g. duration of pressure pulse, frequency of pressure pulse, or other suitable methods, may be used to send inclination information to the surface. The passages 68, 54 used for telemetry may be sized to create a larger pressure drop than that associated with energization of pistons 56. In some applications, alignment of passages 68, 54 used for telemetry can be combined with alignment of passages 68, 54 used for piston energization to help strengthen the telemetry signal. Effectively, the sliding valve sleeve 66 serves to provide both steering and telemetry functions in this embodiment.

In another embodiment of directional drilling system 20, the size and spacing of the passages 68 in valve sleeve 66 are adjusted to make possible the energizing of two adjacent steering members 42. This embodiment provides a tool face resolution of 45 degrees instead of 90 degrees when four steering members are employed in the drilling system. As discussed above, the valve sleeve 66 also may be configured with positions for simultaneously activating the plurality of steering members 42 or de-activating the plurality of steering members 42. Additionally, the alignment of the valve sleeve passages 68 with the collar passages 54 may be adjustable, e.g. selectively partially aligned, to afford a greater measure of force control with respect to the steering members 42. To better achieve the desired force control, leakage paths may be provided past the pistons 56 to the surrounding annulus. The leakage paths effectively reduce the pressure applied by steering members 42 under reduced flow conditions when passages 68, 54 are partially aligned.

Figure 6:
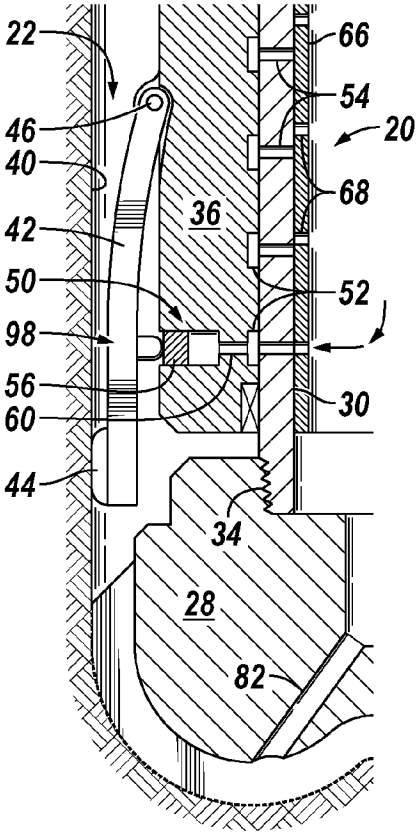
FIG. 6 is an illustration of a portion of another example of the steering system, according to an embodiment of the disclosure.

Referring generally to FIG. 6, another embodiment of steering members 42 is illustrated. In this embodiment, the contact pad 44 is moved closer to the drill bit 28 and the displacement of the contact pad 44 is amplified. In some applications, the steering members 42 are in the form of reverse ribs which move the push point closer to the drill bit 28. The reverse ribs 42 may be telescopic or pivoted upwardly about pivot 46 to facilitate threaded engagement of drill bit 28 with collar 30. The ribs/steering members 42 are then pivoted downwardly to the position illustrated in FIG. 5 prior to running in hole. In other applications, the steering members 42 can be made detachable to facilitate attaching of drill bit 28 to collar 30. As illustrated, each piston 56 acts against the corresponding steering member 42 at a location 98, e.g. a push point, between pivot 46 and contact pad 44 to amplify movement when the contact pad 44 is moved against wall 40 of borehole 22. The contact pad 44 is closer to drill bit 28 than pivot 46. In some applications, steering control may be improved by such a reduction in the bit to actuation distance and by amplifying the total lateral displacement of the rib for a given movement of the corresponding piston 56.

It should be noted that the directional drilling system 20 may be modified to accommodate various parameters of a given application. For example, drill bit make-up can be facilitated by slidably and rotatably positioning the steering structure 36 on collar 30. During bit make-up, the non-rotating steering structure 36 is slid up relative to collar 30 and held in this upward position to better expose mounting end 34 for attachment of drill bit 28. After bit make-up, the steering structure 36 is slid back to its drilling position and secured. In another modification, annular grooves 52 may be located in collar 30 for cooperation with corresponding ports in the steering structure/sleeve 36 for each actuator piston 56.

Figure 7:
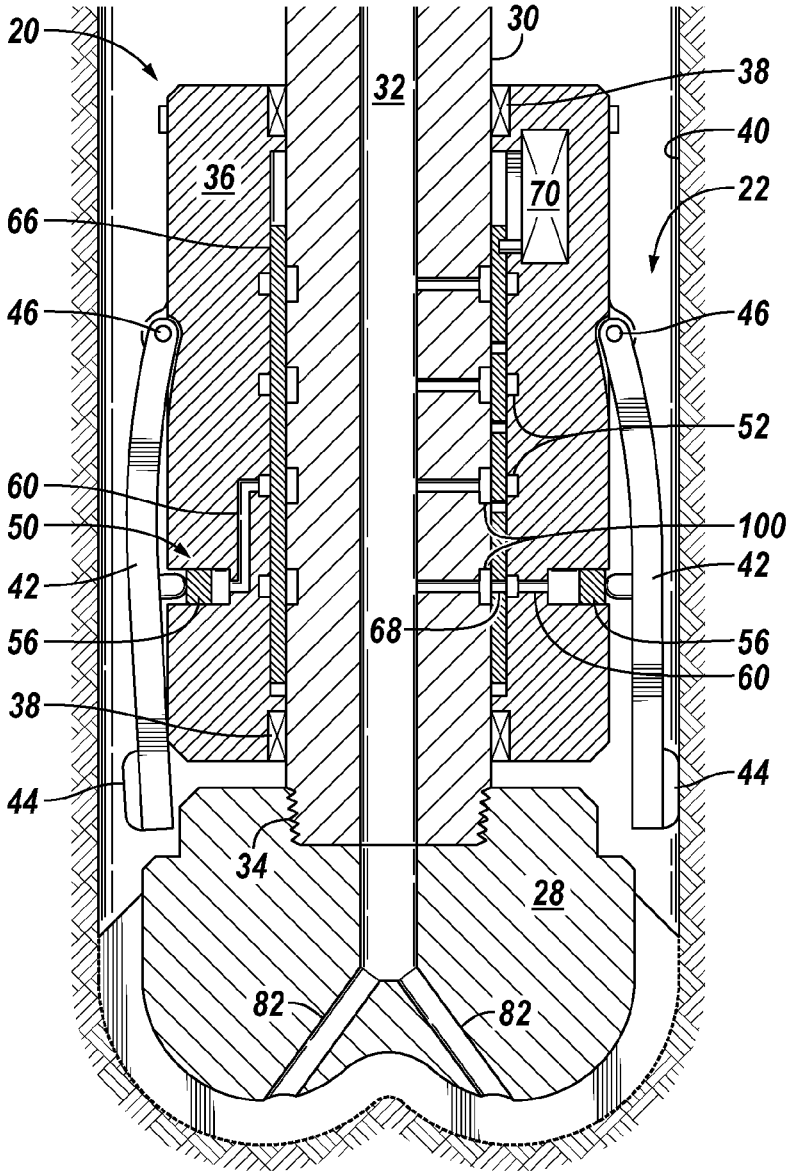
FIG. 7 is an illustration of another example of the steering system, according to an embodiment of the disclosure.

Another modification is illustrated in FIG. 7. In this embodiment, the sliding valve sleeve 66 is sandwiched between the collar 30 and the non-rotating steering structure 36. Ported annular channels 100 in the collar 30 provide a path to the high-pressure internal side of the sliding valve sleeve 66. Passages 68 in the sliding valve sleeve 66 again selectively connect the high-pressure drilling fluid within collar 30 with the actuator pistons 56 and corresponding steering members 42 via ports 60. By way of example, the sliding sleeve 66 may be axially displaced to selectively align a given passage 68 with a desired port 60, thus providing a flow path to the corresponding actuator piston 56.

In the example illustrated in FIG. 6, ported annular channels 100 are provided in collar 30 and annular grooves 52 are provided in the steering sleeve 36. This allows the valve sleeve 66 to rotate free of both the collar 30 and the steering sleeve 36. In other embodiments, however, the valve sleeve 66 does not rotate with collar 30 and this enables use of ports in the steering sleeve 36 rather than annular grooves 52. In the embodiment of FIG. 6, the sliding sleeve motive unit 70 may be mounted on the steering structure/sleeve 36. Mounting of motive unit 70 on steering sleeve 36 may be used to avoid both electrical connections with the inside of the collar 30 and transmission of electrical power or signals across rotating surfaces.

Additionally, verticality sensors 74 may be mounted on steering structure 36. In this example, the verticality sensors 74 move with the nominally non-rotating steering sleeve 36 so there is no ambiguity with respect to steering member position or with respect to which steering member 42 is to be actuated via movement of the valve sleeve 66. As with other embodiments, a variety of steering members, steering member orientations, and push points may be used to provide the desired steering inputs.

Figure 8:
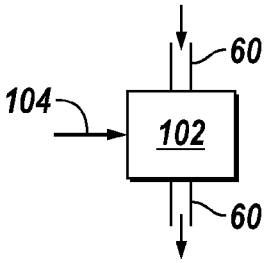
FIG. 8 is an illustration of a flow control device which controls flow of actuating fluid in an example of the steering system, according to an embodiment of the disclosure.

In another embodiment, the valve sleeve 66 may be replaced with discreet valves 102 positioned along the flow passage or port 60, as illustrated schematically in FIG. 8. By way of example, the valves 102 may be in the form of digital mud valves which are selectively opened and closed via input of an electrical signal 104, e.g a discrete electrical signal. A plurality of valves 102 may be located along high-pressure flow passages, e.g. ports 60, corresponding with the plurality of steering members 42. The valves 102 may be selectively actuated by controller 76 to control the flow of pressurized drilling fluid, e.g. drilling mud, from a high-pressure source within collar 30 to the selected pistons 56 and associated steering members 42.

By way of example, sensors 74 may comprise a single, highly damped, laterally mounted accelerometer mounted on the steering structure 36 and associated with a pair of the digital mud valves 102. The mud valves 102 are positioned to energize two opposing steering members 42. In this example, the high-pressure mud supply within collar 30 may be ported to a cavity in the steering structure 36 connected through the digital mud valves 102. The accelerometer signal is used to control actuation of the digital mud valves 102 so as to energize the desired steering member 42 for maintaining verticality or other directional control. An additional accelerometer can be used to control each additional opposing pair of steering members 42.

In another embodiment, the sensor system 72 may be an electrical/electromagnetic system employing sensors 74 in the form of a suitable compound pendulum for the verticality measurement combined with a potentiometer (or switch) driving the electromagnetic circuit of the digital mud valve 102. By way of example, the digital mud valve 102 may comprise a solenoid driven poppet valve. The sensor system 72 also could be made of high temperature analog components. Referring again to FIG. 3, the illustrated sensors 74 can be constructed as two pendulums (e.g. accelerometers or compound pendulums) set orthogonally to determine tilt which is then used for actuating the appropriate digital mud valve 102 and corresponding steering member 42. In many applications, a low-cost, high temperature microprocessor and accelerometer-based system may be used to obtain sensor data which is then telemetered to a surface control or other controller.

Depending on the application, verticality measurements and/or other sensor measurements may be taken when the drill bit 28 is rotating, not rotating, or both. When measurements are taken during drilling, considerable noise may exist and the sensor measurements may be filtered appropriately. To avoid the noise, verticality measurements or other sensor measurements may be taken when the drill bit 28 is stationary (or when the system is off bottom and slowly rotating). Once the direction of tilt is obtained, the appropriate actuator piston 56 and steering member 42 can be energized and drilling may be continued. The distance drilled between sensor readings, e.g. between verticality readings, can be based on selected parameters related to the environment, drilling equipment, and/or drilling operation.

Depending on the application, the components of the directional drilling system may have a variety of sizes, configurations, and arrangements. For example, the steering members may be actuated in a transverse direction telescopically or pivotably. The non-rotating steering structure may be in the form of a steering sleeve or other types of structures which may remain stationary or substantially stationary with respect to the surrounding borehole wall during a drilling operation. The hydraulic network for controlling flow of pressurized fluid to the steering members may utilize several types of sleeve valves, digital valves, or other types of valves which are selectively actuated to control fluid flow. Similarly, differing numbers, types, and arrangements of sensors and controllers may be utilized to provide the desired control signals for actuating the steering members to maintain verticality or other desired orientation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for drilling a borehole, comprising:

providing a drill bit at an end of a collar having an internal flow passage:

rotatably positioning the collar within a steering sleeve to which a plurality of steering members is mounted for selective lateral motion with respect to the steering sleeve;

while maintaining the steering sleeve in a rotationally stationary position with respect to the borehole, rotating the collar and the drill bit to perform a drilling operation; and adjusting a drilling orientation of the collar and the drill bit by routing drilling fluid from the internal flow passage to at least one select steering member to cause the selective lateral motion while the steering sleeve remains in the rotationally stationary position, wherein adjusting comprises moving a valve sleeve to selectively control flow of fluid from the internal flow passage to specific actuators associated with specific steering members.

2. The method as recited in claim 1, further comprising using a sensor system to determine verticality of drilling, and actuating the at least one steering member to maintain verticality of drilling.

3. The method as recited in claim 2, wherein using the sensor system comprises using a single accelerometer and a single magnetometer for verticality measurement.

4. The method as recited in claim 1, further comprising pivotably coupling each steering member of the plurality of steering members to the steering sleeve.

5. The method as recited in claim 4, further comprising coupling an actuator piston to a corresponding steering member; and slidably mounting each actuator piston in the steering sleeve.

6. The method as recited in claim 5, wherein coupling comprises positioning each actuator piston to act against its corresponding steering member at a location between a pivot and a pad oriented to contact a wall of the borehole, the pad being closer to the drill bit than the pivot.

7. The method as recited in claim 1, wherein moving the valve sleeve comprises using an electric motor to move the valve sleeve.

8. The method as recited in claim 1, wherein moving the valve sleeve comprises moving the valve sleeve rotationally.

9. The method as recited in claim 1, further comprising using the valve sleeve for both steering and telemetry.

10. The method as recited in claim 1, further comprising locating the valve sleeve between the collar and the steering sleeve.

11. The method as recited in claim 1, further comprising using coils on the collar and the steering sleeve to transmit signals.

12. The method as recited in claim 1, further comprising using tilted coils mounted on the steering sleeve.

13. A system for drilling, comprising:

a steering system having:

a collar comprising an internal flow passage and an end for mounting a drill bit;

a steering sleeve mounted about the collar via a bearing which enables rotation of the collar within the steering sleeve while the steering sleeve remains rotationally stationary with respect to a surrounding borehole wall;

a plurality of steering members mounted to the steering sleeve for selective lateral movement against the surrounding borehole wall;

a hydraulic network between the internal flow passage and the plurality of steering members; and an actuator operable to control flow through the hydraulic network to actuate selected steering members of the plurality of steering members during rotation of the collar while the steering sleeve remains rotationally stationary, the actuator comprising a valve sleeve configured to selectively control flow of fluid from the internal flow passage to specific actuators associated with specific steering members.

14. The system as recited in claim 13, further comprising a sensor system positioned to sense verticality of the collar during a drilling operation, the sensor system outputting data to a controller which actuates the steering members.

15. The system as recited in claim 13, further comprising the drill bit coupled to the collar and a drill string coupled to the steering system.

16. A method, comprising:

rotatably positioning a collar having an internal flow passage in a steering structure;

turning a drill bit in a borehole by rotating the collar relative to the steering structure; and shifting the steering structure laterally in the borehole by actuating at least one selected steering member of a plurality of steering members acting between the steering structure and a wall of the borehole, the actuating comprising moving a valve sleeve to selectively control flow of fluid from the internal flow passage to specific actuators associated with specific steering members.

17. The method as recited in claim 16, further comprising coupling a hydraulic control network with a plurality of pistons positioned to individually actuate steering members of the plurality of steering members.

18. The method as recited in claim 16, further comprising using a closed loop control system to maintain verticality of drilling by adjusting selected steering members of the plurality of steering members.

* * * * *